US007438363B1

(12) United States Patent
Sutherland

(10) Patent No.: US 7,438,363 B1
(45) Date of Patent: Oct. 21, 2008

(54) WHEELCHAIR BRIDGE

(76) Inventor: James Sutherland, 5221 Flaxman St., Apt., 108, Pensacola, FL (US) 32506

( * ) Notice: Subject to any disclaimer, the term of this patent is extended or adjusted under 35 U.S.C. 154(b) by 0 days.

(21) Appl. No.: 11/975,355

(22) Filed: Oct. 17, 2007

Related U.S. Application Data

(60) Provisional application No. 60/852,128, filed on Oct. 17, 2006.

(51) Int. Cl.
*A47B 97/00* (2006.01)

(52) U.S. Cl. ..... 297/463.1; 297/463.2; 297/162; 297/173; 297/411.23; 297/411.32; 280/304.1

(58) Field of Classification Search ..... 297/463.1, 297/463.2, 162, 173, 411.23, 411.32; 280/304.1
See application file for complete search history.

(56) References Cited

U.S. PATENT DOCUMENTS 827,125 A * 7/1906 Turner ..... 297/411.1
4,081,198 A * 3/1978 Penney ..... 297/153
4,662,676 A * 5/1987 Havelock ..... 297/160
5,139,309 A * 8/1992 Kornreich ..... 297/162
5,299,824 A * 4/1994 Roberts et al. ..... 280/304.1
5,333,929 A * 8/1994 Slagerman ..... 297/155
5,490,710 A * 2/1996 Dearing et al. ..... 297/162
5,842,745 A * 12/1998 Kelly et al. ..... 297/411.23
6,669,287 B1 * 12/2003 DeLilla ..... 297/243
7,210,735 B2 * 5/2007 Lang ..... 297/155
7,216,929 B2 * 5/2007 Lang et al. ..... 297/155

* cited by examiner

*Primary Examiner*—Laurie K Cranmer
(74) *Attorney, Agent, or Firm*—Peter Loffler

(57) ABSTRACT

A bridge that is attached to a wheelchair such that the bridge allows a wheelchair user to have support for ingress into and egress from the wheelchair without assistance and without the need to rely primarily on arm strength alone. The bridge is a generally L-shaped member that has a pair of aligned slits located on a lower portion thereof such that respective connection members pass through each slit and attach the bridge to a frame of the wheelchair the connection members allowing the bridge to be pivoted out of the way when needed.

6 Claims, 4 Drawing Sheets

WHEELCHAIR BRIDGE

This application claims the benefit of provisional patent application No. 60/852,128 filed on Oct. 17, 2006, which provisional application is incorporated herein by reference.

BACKGROUND OF THE INVENTION

1. Field of the Invention

The present invention relates to a bridge where one or two of the bridges are attached to opposing side rails of a wheelchair such that each bridge offers assistance and support for a user of the wheelchair during ingress into and egress from the wheelchair allowing the user to use upper body strength to accomplish the ingress and egress, each bridge capable of being pivoted out of the way.

2. Background of the Prior Art

People who are bound to wheelchairs must often leave the wheelchair for other purposes, such as going to the bathroom, entering a swimming pool, attending to physical therapy, going to bed, getting into a vehicle, getting into a shower, etc. Some wheelchair bound people are sufficiently ambulatory so that getting into and out of the wheelchair can be accomplished with relative ease, however, others must rely on assistance to accomplish such ingress and egress tasks.

Some wheelchair bound people are fortunate to have a fulltime assistant that helps such wheelchair bound people, with among other things, getting out of the wheelchair and back in without undue difficulty. However, as such personal assistants tend to be very expensive, few people are able to afford such a high level of care. Other wheelchair bound folks rely on wheelchair assist devices to help them get into and out of the wheelchairs. Such devices, which include hand grips attached to bathroom walls and shower stalls, etc.; have become quite prevalent over the last few years. However, not all facilities are so equipped and the wheelchair bound person must find other ways to enter and exit their wheelchair when such devices are nowhere to be found.

Some folks simply use the wheelchair itself as an aid in getting up and down. While some find the wheelchair as a sufficient support aid, others cannot use the wheelchair as an egress tool due to the inordinate amount of arm strength that is needed to pull oneself up out of the wheelchair. Others rely on assist devices such as canes that are carried with the wheelchair which assist devices are used to get up out the chair. However, carrying one or a pair of canes can be awkward and the use of these canes also can be quite difficult, especially if the wheelchair has a relatively wide wheelbase which requires that the canes are placed relatively wide with respect to the person using the canes. Additionally, the use of canes for pulling up requires a fair amount of arm strength to pull oneself up out of the seat of the wheelchair.

What is needed is a device that allows a person to be self-sufficient in a wheelchair so that the person can get out of the wheelchair and back in without having to rely on either another person or an external assist device for such egress and ingress. Such a device must not rely mainly on arm strength of the user and must not require that the wheelchair bound person need to rely on their entire upper body for proper use of the device. Such a device should not be unduly cumbersome to transport and should be of relatively simple design and construction and be easy to install and use by the wheelchair bound person.

SUMMARY OF THE INVENTION

The wheelchair bridge of the present invention addresses the aforementioned needs in the art by providing a device that allows a person to be relatively self-sufficient in a wheelchair so that the person can get out of the wheelchair and back in without having to rely on either another person or an external assist device, such as a cane, for such wheelchair egress and ingress. The wheelchair bridge does not rely mainly on arm strength of the user and does not require that the wheelchair bound person need to rely on their entire upper body for proper use of the device during ingress and egress from the wheelchair. The wheelchair bridge is not be unduly cumbersome to transport and is of relatively simple design and construction and is easy to install and use by a wheelchair bound person.

The wheelchair bridge of the present invention is comprised of a relatively flat board member that has a lower portion with a straight inner edge, a rounded bottom and an outwardly extending outer edge as well as an upper portion that has a rounded outer corner that extends from the outer edge of the lower portion, a generally straight top edge extends from the outer corner from which top edge a rounded inner corner extends to a generally straight upper edge, which then extends to a rounded lower corner from which extends a diagonal edge which meets the inner edge at an inset corner. A first slit is disposed within the lower portion of the bridge member proximate to and generally parallel with the straight edge while a second slit is disposed within the lower portion of the bridge member proximate to and generally parallel with the straight edge and above the first slit and aligned with the first slit. A first connection member has a first bottom portion that passes through the first slit while a second connection member has a second bottom portion that passes through the second slit. The board member is positioned on a side of a wheelchair on an inner first side of a frame of the wheelchair such that the first slit and the second slit are each located proximate a horizontal rail of the frame of the wheelchair and such that an upper portion of the board member faces upwardly, a bottom portion of a J-hook of each connector is hooked onto the horizontal rail of the frame of the wheelchair and tightened in place thereat. The lower portion and the upper portion of the board member are of monolithic construction. A hand grip opening is located on the upper portion of the bridge member proximate to and parallel with the upper edge.

BRIEF DESCRIPTION OF THE DRAWINGS

Similar reference numerals refer to similar parts throughout the several views of the drawings.

DESCRIPTION OF THE PREFERRED EMBODIMENT

Figures 1, 2:
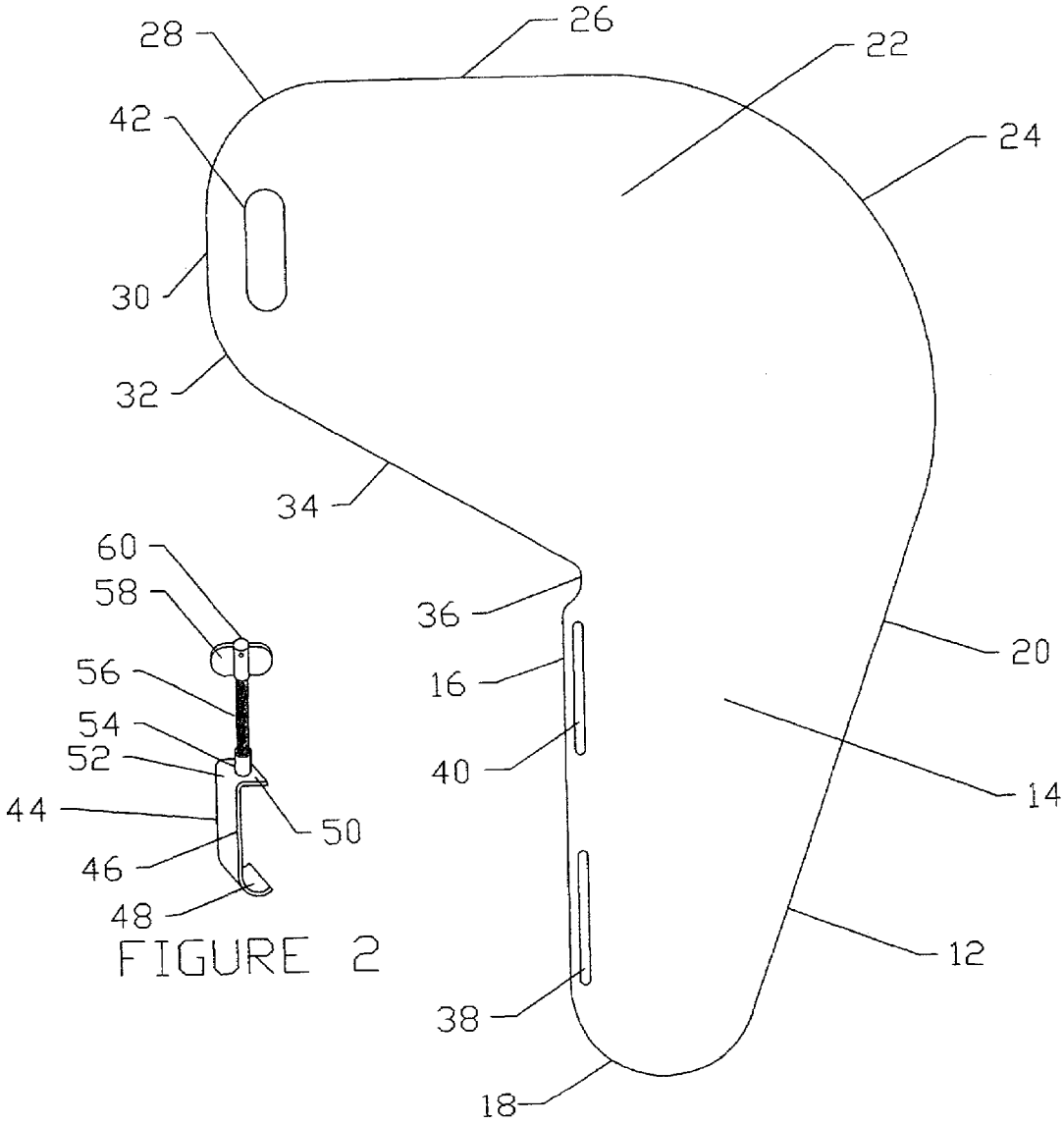
FIG. 1 is a plan view of the bridge member of the wheelchair bridge of the present invention.
FIG. 2 is a perspective view of the connecting member used with the wheelchair bridge.
Figure 3:
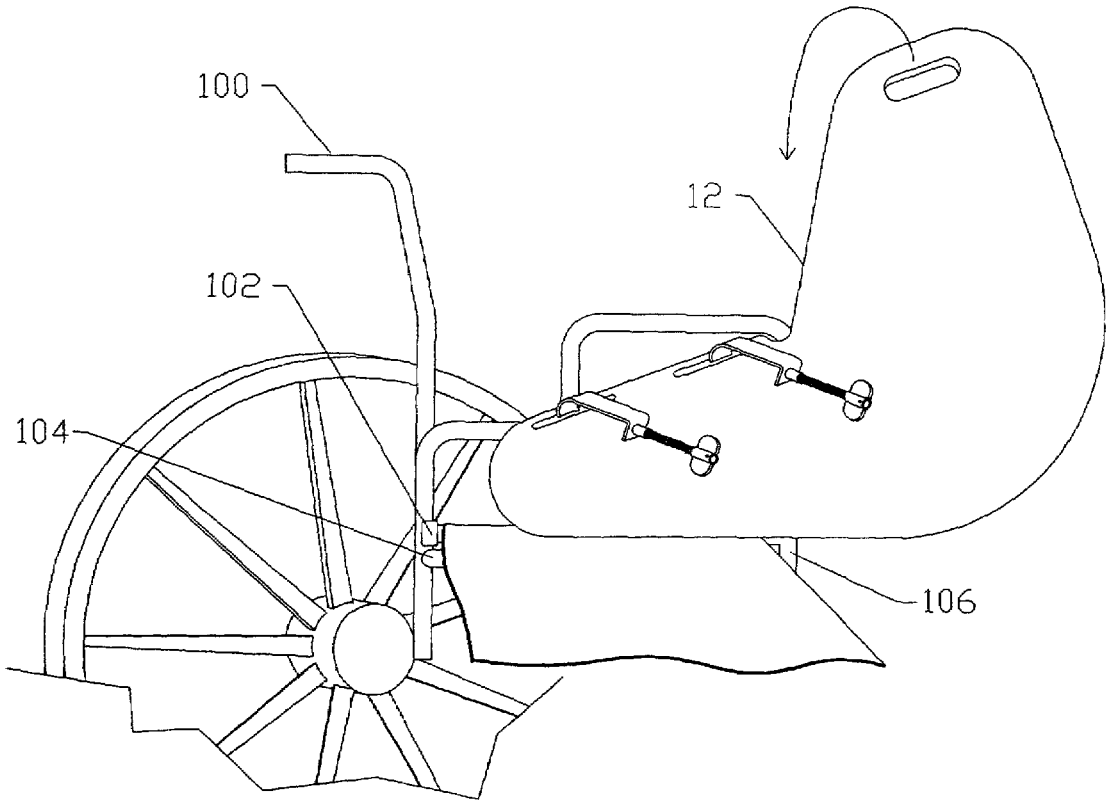
FIG. 3 is an environmental view of the wheelchair bridge attached to a wheelchair with the bridge in a standby position.
Figure 4:
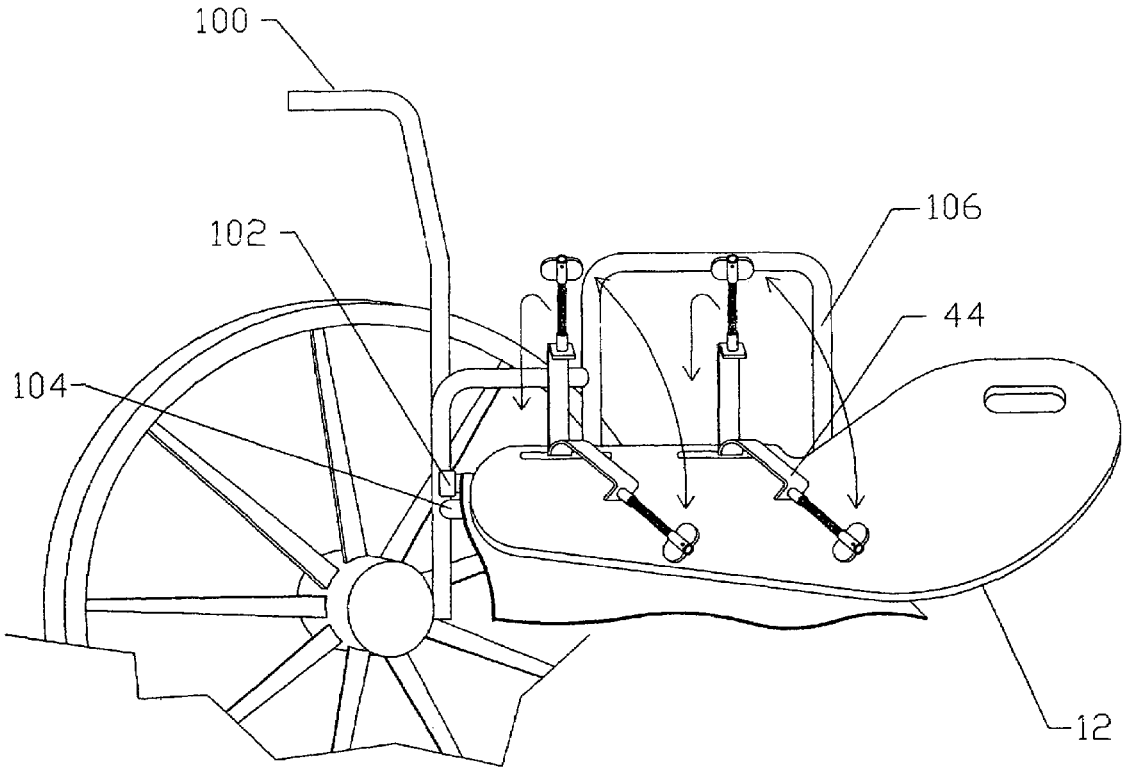
FIG. 4 is an environmental view of the wheelchair bridge attached to a wheelchair with the bridge in a ready position.
Figure 5:
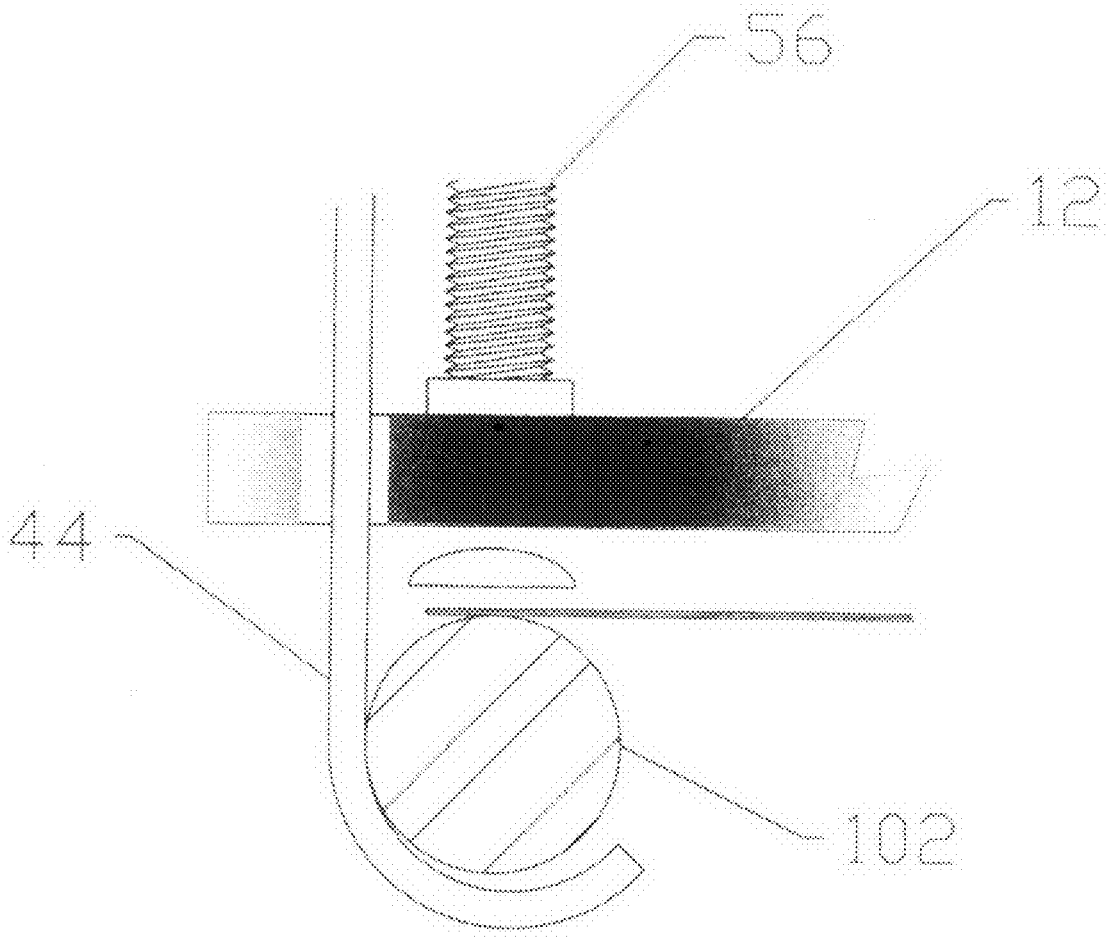
FIG. 5 is a close-up detail view of the connector of the wheelchair bridge attached to the frame of a wheelchair.

The wheelchair bridge of the present invention, generally denoted by reference numeral 10, is comprised of a bridge member 12 that is a relatively flat board member that is made from an appropriate sturdy material such as plastic, wood, aluminum, etc. As seen, the bridge member 12 has a lower portion 14 that has a straight inner edge 16, a rounded bottom 18 and an outwardly extending outer edge 20. The bridge member 12 also has an upper portion 22 that has a rounded outer corner 24 that extends from the outer edge 20 of the lower portion 14. A generally straight top edge 26 extends from the outer corner 24 from which top edge 26 a rounded inner corner 28 extends to a generally straight upper edge 30, which then extends to a rounded lower corner 32 from which extends a diagonal edge 34 which meets the inner edge 16 at an inset corner 36. The lower portion 14 and the upper portion 22 are of monolithic construction.

A first slit 38 is located in the lower portion 14 of the bridge member 12 proximate to and parallel with the straight edge 16. A second slit 40 is also located in the lower portion 14 of the bridge member 12 proximate to and parallel with the straight edge 16 above the first slit 38. A hand grip opening 42 is located on the upper portion 22 of the bridge member 12 proximate to and parallel with the upper edge 40.

As seen in FIG. 2 a connection member 44 has a J-hook 46 that has a rounded bottom portion 48 and a relatively flat top portion 50 joined by a neck 52. A threaded boss 54 is located on the top portion 50 of the connection member 44. A threaded shaft 56 is received within the boss 54, the threaded shaft 56 having a foot 58 on its lower end and a thumb screw 60 located on its upper end.

In use, a connection member 44 is provided for the first slit 38 such that its bottom portion 48 passes through the first slit 38. A second connection member 44 is provided for the second slit 40 such that its bottom portion 48 passes through the second slit 40. The bridge member 12 is positioned on the left-hand side of a wheelchair 100 on the inner side of the frame 102 of the wheelchair 100 such that the two slits 38 and 40 are located proximate a horizontal rail 104 of the frame 102 of the wheelchair 100. With the upper portion 22 of the bridge member 12 facing upwardly, the bottom portion 48 of the J-hook 46 of each connector 44 is hooked onto the horizontal rail 104. At this point, each shaft 56 is tightened by turning the thumb screw 60 unlit the foot 58 of the threaded shaft 56 engages the bridge member 12 and presses the bridge member 12 down onto the horizontal rail 104. The shaft 56 is not completely tightened at this point. Thereafter, the bride member 12 is rotated outwardly so that the upper portion 22 of the bridge member 12 rotates outwardly away from the person in the wheelchair 100. The inset corner 36 of the bridge member 12 allows the bridge member 12 to be able to clear any vertical rail 106 that might otherwise impede outward rotation of the bridge member 12.

When the bridge member 12 is horizontal, and thus the two connection members 44 within the two slits 38 and 40 respectively, are generally vertical, the shaft 56 of each connector 44 is fully tightened in order to clamp the bridge member 12 to the horizontal rail 104 of the frame 102 of the wheelchair 100 via the connectors 44. A second bridge member 12 is attached to the right-hand side of the wheelchair 100 in substantially similar fashion. When each bridge member 12 is fully installed in a horizontal position, the user of the wheelchair 100 can use the two bridge members 12 (in some cases only one bridge member 12 is needed and installed) for assistance in getting into and out of the wheelchair 100. As the bridge members 12 are horizontally disposed at torso level for a person sitting in the wheelchair 100, the person can rest his or her forearms on each bridge member 12 and use all of his or her upper body strength (as opposed to mainly arm strength) for wheelchair 100 ingress and egress. The hand grip opening 42 can be used by the wheelchair user for holding the bridge member 12 during installation as well as a hand grip assist during ingress and egress from the wheelchair 100.

In order to remove the bridge member 12 from the wheelchair 100, the shaft 56 is counterrotated so as to loosen the attachment of the bridge member 12 with the horizontal rail 104 of the wheelchair 100. The bridge member 12 is counterrotated back upwardly until the bottom portions 48 of each J-hook 46 of each connector 44 can be unhooked from the horizontal rail 104 of the wheelchair 100 and the bridge member 12 is removed. The bridge member 12 from the opposite side of the wheelchair 100 is similarly removed.

While the invention has been particularly shown and described with reference to an embodiment thereof, it will be appreciated by those skilled in the art that various changes in form and detail may be made without departing from the spirit and scope of the invention.

I claim:

1. A bridge for use with a wheelchair, the bridge comprising:

a relatively flat board member that having a lower portion that has a straight inner edge, a rounded bottom and an outwardly extending outer edge and an upper portion that has a rounded outer corner that extends from the outer edge of the lower portion, a generally straight top edge extends from the outer corner from which top edge a rounded inner corner extends to a generally straight upper edge, which then extends to a rounded lower corner from which extends a diagonal edge which meets the inner edge at an inset corner;

a first slit disposed within the lower portion of the bridge member proximate to and generally parallel with the straight edge;

a second slit disposed within the lower portion of the bridge member proximate to and generally parallel with the straight edge and above the first slit;

a first connection member having a first bottom portion passing through the first slit;

a second connection member having a second bottom portion passing through the second slit; and wherein the board member is adapted to be positioned on a side of a wheelchair on an inner first side of a frame of the wheelchair such that the first slit and the second slit are each located proximate a horizontal rail of the frame of the wheelchair and such that an upper portion of the board member faces upwardly, a bottom portion of a J-hook of each connector is hooked onto the horizontal rail and tightened in place thereat.

2. The bridge as in claim 1 wherein the lower portion and the upper portion are of monolithic construction.

3. The bridge as in claim 1 further comprising a hand grip opening located on the upper portion of the bridge member proximate to and parallel with the upper edge.

4. The bridge as in claim 1 in combination with the wheelchair.

5. The bridge as in claim 4 wherein the lower portion and the upper portion are of monolithic construction.

6. The bridge as in claim 4 further comprising a hand grip opening located on the upper portion of the bridge member proximate to and parallel with the upper edge.

* * * * *